US010112802B2

(12) United States Patent
Dube

(10) Patent No.: US 10,112,802 B2
(45) Date of Patent: Oct. 30, 2018

(54) ELEVATOR SERVICE PERSON COLLISION PROTECTION SYSTEM

(71) Applicant: Otis Elevator Company, Farmington, CT (US)

(72) Inventor: Randall S. Dube, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 51 days.

(21) Appl. No.: 15/419,680

(22) Filed: Jan. 30, 2017

(65) Prior Publication Data

US 2018/0215577 A1 Aug. 2, 2018

(51) Int. Cl.
*B66B 5/00* (2006.01)

(52) U.S. Cl.
CPC ..... *B66B 5/005* (2013.01); *B66B 5/0031* (2013.01)

(58) Field of Classification Search
CPC ..... B66B 5/005; B66B 5/0031
USPC ..... 187/390
See application file for complete search history.

(56) References Cited

U.S. PATENT DOCUMENTS 5,025,895 A * 6/1991 Leone ..... B66B 5/0031 187/277
5,644,111 A * 7/1997 Cerny ..... B66B 13/14 187/280
5,703,367 A * 12/1997 Hashimoto ..... G06K 9/00369 250/342
6,202,797 B1 * 3/2001 Skolnick ..... A41D 13/00 187/279
6,467,585 B1 * 10/2002 Gozzo ..... B66B 13/22 187/247
6,598,703 B1 * 7/2003 Catalan ..... A62B 1/20 182/48
6,945,363 B2 * 9/2005 Angst ..... B66B 13/143 187/300
6,988,594 B2 * 1/2006 Deplazes ..... B66B 13/22 187/316

(Continued)

FOREIGN PATENT DOCUMENTS

CN 202931508 U 5/2013
CN 203529637 U 4/2014

(Continued)

OTHER PUBLICATIONS

EP Extended European Search Report for Application No. 18154287.9-1017; dated Jun. 14, 2018; dated Jul. 9, 2018; 1-9 pages.

*Primary Examiner* — David Warren
(74) *Attorney, Agent, or Firm* — Cantor Colburn LLP

(57) ABSTRACT

According to one embodiment, an elevator car collision protection system is provided. The collision protection system comprising: a first antenna configured to be worn by a person entering a hoistway; a first trio of transceivers located a first selected distance away from a first impact wall of the hoistway, the first trio of transceivers being configured to detect a first clearance between an elevator car within the hoistway and the first trio of transceivers and a second clearance between the first antenna and the first trio of transceivers; and an alarm configured to activate when a collision risk level exceeds a selected risk level, wherein the collision risk level is determined in response to the first clearance and the second clearance.

18 Claims, 3 Drawing Sheets

(56) References Cited

U.S. PATENT DOCUMENTS

| | | | | |
|---|---|---|---|---|
| 7,350,625 | B2 * | 4/2008 | Deplazes | B66B 13/125 187/314 |
| 7,426,981 | B2 | 9/2008 | Bacellar et al. | |
| 7,980,363 | B2 * | 7/2011 | Kattainen | B66B 5/0056 187/247 |
| 8,556,043 | B2 | 10/2013 | Mangini et al. | |
| 9,272,878 | B2 * | 3/2016 | Kocher | B66B 5/005 |
| 9,359,171 | B1 * | 6/2016 | Nowel | B66B 5/0056 |
| 9,463,955 | B2 * | 10/2016 | Preston | B66B 1/468 |
| 2011/0155510 | A1 * | 6/2011 | Lindberg | B66B 5/005 187/314 |
| 2011/0247376 | A1 * | 10/2011 | Umbaugh | B66B 13/16 70/91 |
| 2011/0303492 | A1 * | 12/2011 | Sonnenmoser | B66B 13/22 187/247 |
| 2013/0246928 | A1 | 9/2013 | Hovi et al. | |
| 2014/0069745 | A1 | 3/2014 | Dellarippa et al. | |
| 2016/0267767 | A1 * | 9/2016 | Palazzola | B66B 5/00 |
| 2017/0355558 | A1 * | 12/2017 | Khalil | B66B 5/0031 |

FOREIGN PATENT DOCUMENTS

| | | | |
|---|---|---|---|
| CN | 205061218 | U | 3/2016 |
| JP | H02295868 | A | 12/1990 |
| JP | H02295869 | A | 12/1990 |
| JP | H05155547 | A | 6/1993 |
| JP | 2010195530 | A | 9/2010 |
| JP | 2014015300 | A | 1/2014 |
| WO | 02066357 | A1 | 8/2002 |
| WO | 2008072023 | A1 | 6/2008 |
| WO | 2011015895 | A1 | 2/2011 |

* cited by examiner

ELEVATOR SERVICE PERSON COLLISION PROTECTION SYSTEM

BACKGROUND

The subject matter disclosed herein relates generally to the field of elevator systems, and specifically to a method and apparatus for detecting an elevator service person within a hoistway.

The safety of a service person is paramount when work in an elevator hoistway is being conducted. In certain elevator systems, a service person must access a pit of the hoistway or the top of the car for a repair.

BRIEF SUMMARY

According to one embodiment, an elevator car collision protection system is provided. The collision protection system comprising: a first antenna configured to be worn by a person entering a hoistway; a first trio of transceivers located a first selected distance away from a first impact wall of the hoistway, the first trio of transceivers being configured to detect a first clearance between an elevator car within the hoistway and the first trio of transceivers and a second clearance between the first antenna and the first trio of transceivers; and an alarm configured to activate when a collision risk level exceeds a selected risk level, wherein the collision risk level is determined in response to the first clearance and the second clearance.

In addition to one or more of the features described above, or as an alternative, further embodiments of the system may include: a second antenna located in a selected location on the elevator car within the hoistway, wherein the first trio of transceivers is configured to detect the first clearance between the elevator car within the hoistway and the first trio of transceivers using the second antenna.

In addition to one or more of the features described above, or as an alternative, further embodiments of the system may include: a second trio of transceivers located a second selected distance away from a second impact wall of the hoistway, the second trio of transceivers being configured to detect a third clearance between the first antenna and the second trio of transceivers; wherein the alarm is configured to activate when a collision risk level is greater than a selected risk level, wherein the collision risk level is determined in response to the third clearance In addition to one or more of the features described above, or as an alternative, further embodiments of the system may include where the elevator car is stopped when the collision risk level is greater than the selected risk level.

In addition to one or more of the features described above, or as an alternative, further embodiments of the system may include where an ultra-wide band network is created between the second antenna, the first antenna, and the first trio of transceivers.

In addition to one or more of the features described above, or as an alternative, further embodiments of the system may include where the first impact wall is at least one of a bottom floor of the hoistway, a top ceiling of the hoistway, and a side wall of the hoistway.

According to another embodiment, a method of preventing a collision within an elevator hoistway is provided. The method comprising: transmitting a first signal using a first antenna configured to be worn by a person entering a hoistway; receiving the first signal using a first trio of transceivers located a first selected distance away from a first impact wall of the hoistway, the first trio of transceivers being configured to detect a first clearance between an elevator car within the hoistway and the first trio of transceivers and a second clearance between the first antenna and the first trio of transceivers; determining a collision risk level in response to the first clearance and the second clearance; and activating an alarm when the collision risk level exceeds a selected risk level.

In addition to one or more of the features described above, or as an alternative, further embodiments of the method may include: transmitting a second signal using a second antenna located in a selected location on an elevator car within a hoistway; and receiving the second signal using the first trio of transceivers; wherein the first trio of transceivers is configured to detect the first clearance between the elevator car within the hoistway and the first trio of transceivers using the second antenna.

In addition to one or more of the features described above, or as an alternative, further embodiments of the method may include: receiving the first signal using a second trio of transceivers located a second selected distance away from a second impact wall of the hoistway, the second trio of transceivers being configured to detect a third clearance between the first antenna and the second trio of transceivers; determining a collision risk level in response to the third clearance; and activating an alarm when the collision risk level exceeds a selected risk level.

In addition to one or more of the features described above, or as an alternative, further embodiments of the method may include: stopping the elevator car when the collision risk level is greater than the selected risk level.

In addition to one or more of the features described above, or as an alternative, further embodiments of the method may include: creating an ultra-wide band network between the second antenna, the first antenna, and the first trio of transceivers.

In addition to one or more of the features described above, or as an alternative, further embodiments of the method may include where the first impact wall is at least one of a bottom floor of the hoistway, a top ceiling of the hoistway, and a side wall of the hoistway.

According to another embodiment, a computer program product tangibly embodied on a computer readable medium is provided. The computer program product including instructions that, when executed by a processor, cause the processor to perform operations comprising: transmitting a first signal using a first antenna configured to be worn by a person entering a hoistway; receiving the first signal using a first trio of transceivers located a first selected distance away from a first impact wall of the hoistway, the first trio of transceivers being configured to detect a first clearance between an elevator car within the hoistway and the first trio of transceivers and a second clearance between the first antenna and the first trio of transceivers; determining a collision risk level in response to the first clearance and the second clearance; and activating an alarm when the collision risk level exceeds a selected risk level.

In addition to one or more of the features described above, or as an alternative, further embodiments of the computer program may include where the operations further comprise: transmitting a second signal using a second antenna located in a selected location on an elevator car within a hoistway; and receiving the second signal using the first trio of transceivers; wherein the first trio of transceivers is configured to detect the first clearance between the elevator car within the hoistway and the first trio of transceivers using the second antenna.

In addition to one or more of the features described above, or as an alternative, further embodiments of the computer program may include where the operations further comprise: receiving the first signal using a second trio of transceivers located a second selected distance away from a second impact wall of the hoistway, the second trio of transceivers being configured to detect a third clearance between the second antenna and the second trio of transceivers and a fourth clearance between the first antenna and the second trio of transceivers; determining a collision risk level in response to the third clearance and the fourth clearance; and activating an alarm when the collision risk level exceeds a selected risk level.

In addition to one or more of the features described above, or as an alternative, further embodiments of the computer program may include where the operations further comprise: stopping the elevator car when the collision risk level is greater than the selected risk level.

In addition to one or more of the features described above, or as an alternative, further embodiments of the computer program may include where the operations further comprise: creating an ultra-wide band network between the second antenna, the first antenna, and the first trio of transceivers.

In addition to one or more of the features described above, or as an alternative, further embodiments of the computer program may include where the first impact wall is at least one of a bottom floor of the hoistway, a top ceiling of the hoistway, and a side wall of the hoistway.

Technical effects of embodiments of the present disclosure include utilizing an ultra-wide broadband network connected to an antenna on an elevator car, an antenna on a person and a trio of transceivers near an impact wall to prevent an elevator car from harming the person in a collision.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
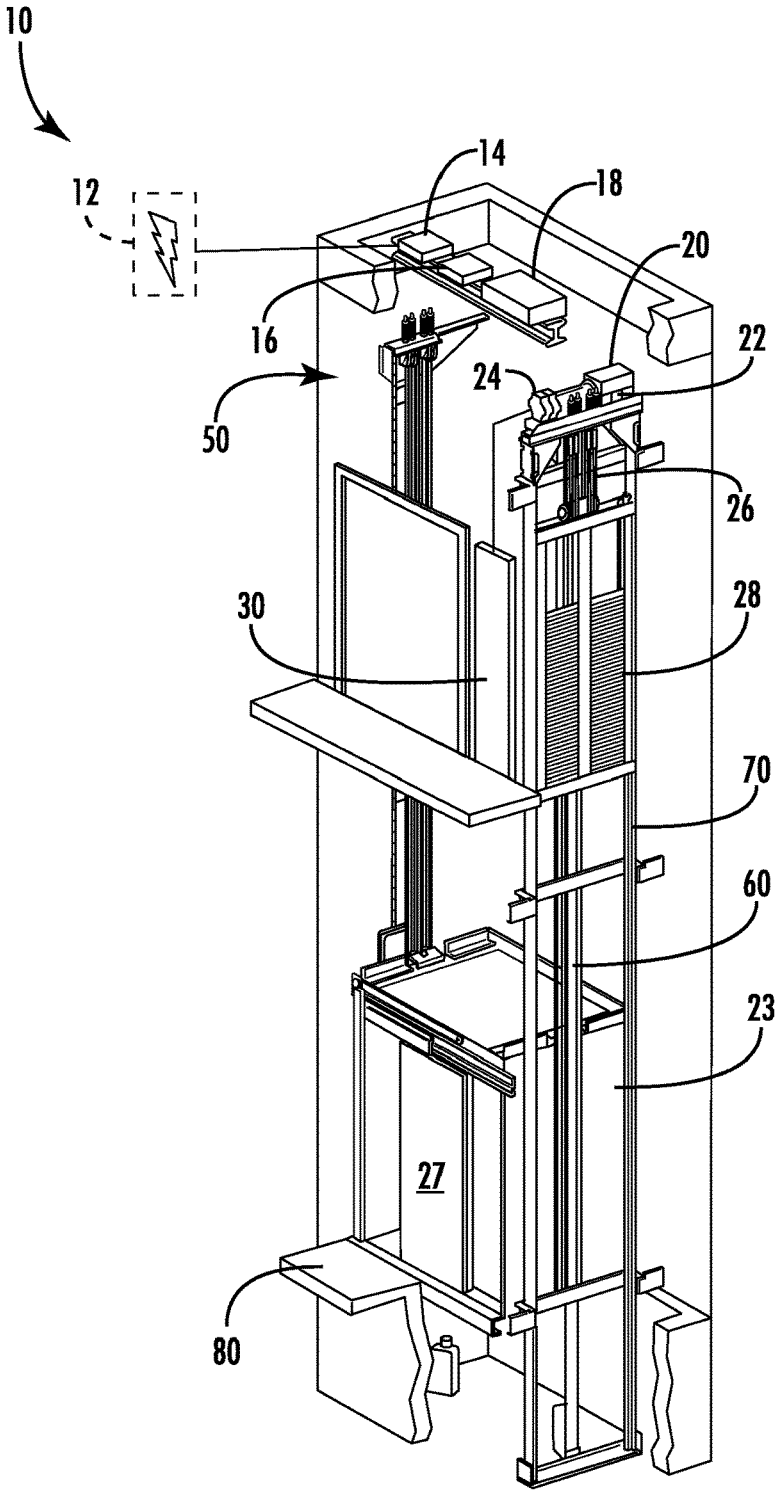
FIG. 1 illustrates a schematic view of an elevator system, in accordance with an embodiment of the disclosure.

FIG. 1 shows a schematic view of an elevator system 10, in accordance with an embodiment of the disclosure. With reference to FIG. 1, the elevator system 10 includes an elevator car 23 configured to move vertically upward and downward within a hoistway 50 along a plurality of car guide rails 60. The elevator system 10 may also include a counterweight 28 operably connected to the elevator car 23 via a pulley system 26. The counterweight 28 is configured to move vertically upward and downward within the hoistway 50. In addition, elevator systems moving laterally and/or diagonally may also be used. In one embodiment, the elevator car 23 may move laterally. In another embodiment, the elevator car 23 may move diagonally. The counterweight 28 moves in a direction generally opposite the movement of the elevator car 23, as is known in conventional elevator systems. Movement of the counterweight 28 is guided by counterweight guide rails 70 mounted within the hoistway 50. The elevator car 23 also has doors 27 to open and close, allowing passengers to enter and exit the elevator car 23 at a floor 80.

The elevator system 10 also includes a power source 12. The power is provided from the power source 12 to a switch panel 14, which may include circuit breakers, meters, etc. From the switch panel 14, the power may be provided directly to the drive unit 20 through the controller 30 or to an internal power source charger 16, which converts AC power to direct current (DC) power to charge an internal power source 18 that requires charging. For instance, an internal power source 18 that requires charging may be a battery, capacitor, or any other type of power storage device known to one of ordinary skill in the art. Alternatively, the internal power source 18 may not require charging from the AC external power source 12 and may be a device such as, for example a gas powered generator, solar cells, hydroelectric generator, wind turbine generator or similar power generation device. The internal power source 18 may power various components of the elevator system 10 when an external power source is unavailable. The drive unit 20 drives a machine 22 to impart motion to the elevator car 23 via a traction sheave of the machine 22. The machine 22 also includes a brake 24 that can be activated to stop the machine 22 and elevator car 23. As will be appreciated by those of skill in the art, FIG. 1 depicts a machine room-less elevator system 10, however the embodiments disclosed herein may be incorporated with other elevator systems that are not machine room-less or that include any other known elevator configuration. In addition, elevator systems having more than one independently operating elevator car in each elevator shaft and/or ropeless elevator systems may also be used. In one embodiment, the elevator car may have two or more compartments.

The controller 30 is responsible for controlling the operation of the elevator system 10. The controller 30 may include a processor and an associated memory. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

Figure 2:
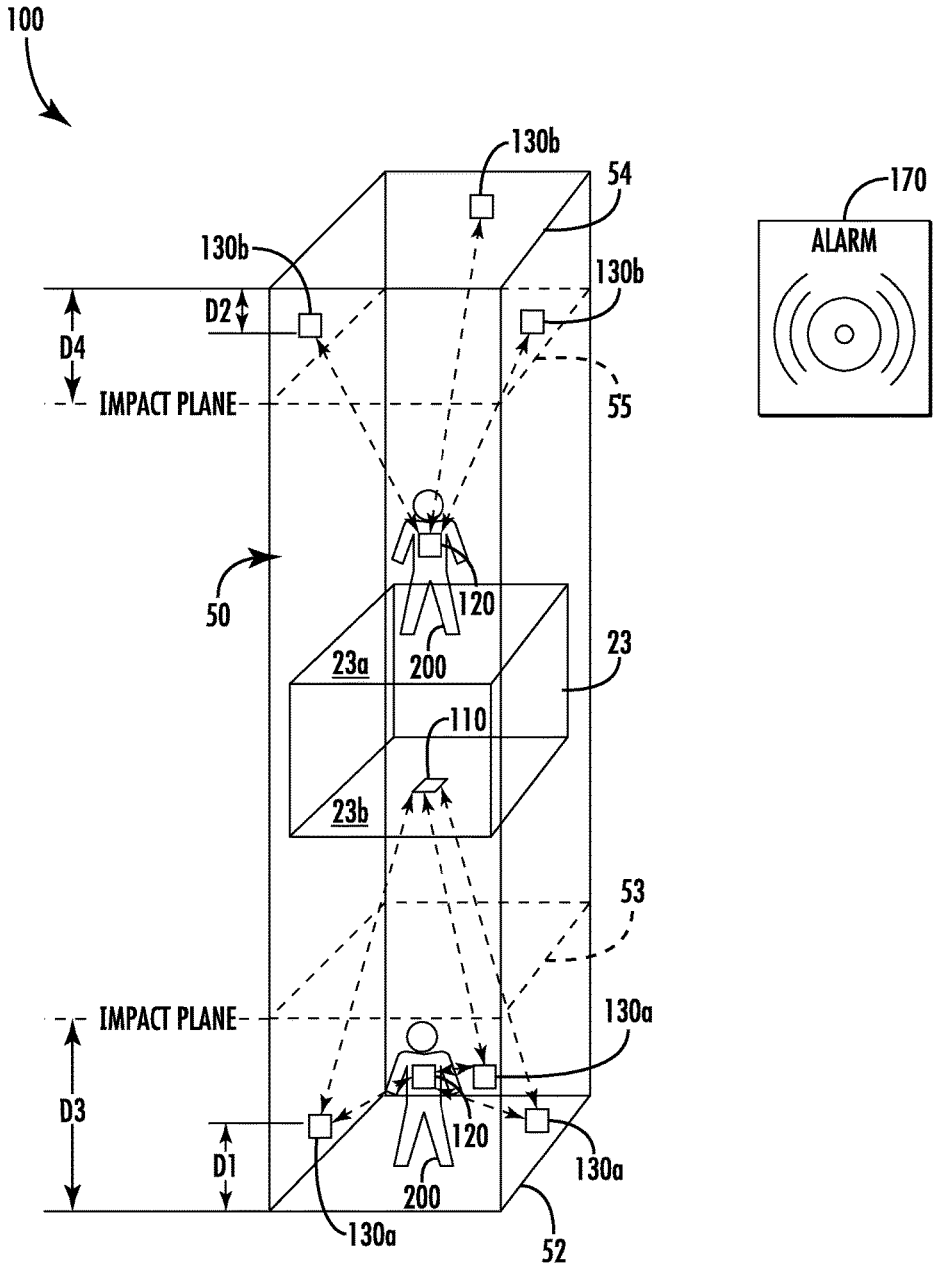
FIG. 2 illustrates a schematic view of an elevator car collision protection system, in accordance with an embodiment of the disclosure.

Referring now to FIG. 2 while referencing FIG. 1, FIG. 2 illustrates an elevator car 23 collision protection system 100, according to an embodiment of the disclosure. The collision protection system 100, comprises a second antenna 110, a first antenna 120, a first trio of transceivers 130*a*, and a second trio of transceivers 130*b*. In one embodiment, groups of more or less than three transceivers 130 may be used. The second antenna 110 is configured to transmit a second signal. The second antenna 110 is located in a selected location on an elevator car 23 within a hoistway 50. In an embodiment, the select location is a bottom 23*b* of the elevator car 23. The selected location may vary as long as the selected location is known and the dimensions of the elevator car 23 are known. The first antenna 120 is configured to transmit a first signal. The first antenna 120 is configured to be worn by a person 200 entering the hoistway 50. In a few non-limiting examples, the first antenna 120 may be in a security badge worn by the person 200, sewn into a clothing article worn by the person 200, clipped onto a key chain carried by the person 200, worn on the wrist of the person 200, or hung around the neck of the person 200. In one embodiment, there may be multiple first antennas 120 worn by a single person 200. For example, a single person 200 may wear an antenna on their torso, two more on their arms or hands, two more on their legs or feet, and one more on their head.

The first trio of transceivers 130*a* are configured to receive the second signal transmitted by the second antenna 110 and the first signal transmitted by the first antenna 120. An ultra-wide band network is created within the hoistway 50 between the first trio of transceivers 130*a,* the second antenna 110, and the first antenna 120. The ultra-wide band network may include the second trio of transceivers 130*b*. The second trio of transceivers 130*b* are configured to receive the first signal transmitted by the first antenna 120. The first trio of transceivers 130*a* and the second trio of transceivers 130*b* are each located proximate to an impact wall. In one embodiment, there may be other trios of receivers located proximate to any obstructions or danger zones within the hoistway 50. The first trio of transceivers 130*a* is located a first selected distance D1 away from a first impact wall 52. In the example of FIG. 2, the first impact wall 52 is the bottom floor of the hoistway 50. The second trio of transceivers 130*b* is located a second selected distance D2 away from a second impact wall 54. In the example of FIG. 2, the second impact wall 54 is the top ceiling of the hoistway 50. In an embodiment, an additional impact wall may be a side wall of the hoist way 50 if the elevator car 23 is configured to move laterally and/or diagonally.

The first trio of transceivers 130*a* are configured to detect a first clearance between the second antenna 110 and the first trio of transceivers 130*a* and a second clearance between the first antenna 120 and the first trio of transceivers 130*a*. A collision risk level is determined in response to the first clearance and the second clearance. The controller 30 may be configured to determine the collision risk level. An alarm 170 may activate when the collision risk level is greater than a selected risk level, which may indicate that the elevator car 23 may collide with a person 200 working in the hoistway 50. The alarm 170 may be audible and/or visual and located in the hoistway 50 and/or worn by the person 200. A first impact plane 53 may be established within the controller 30 to provide added safety margin to the collision protection system 100. The first impact plane 53 may be located at a third selected distance D3 away from the first impact wall 52. The first impact plane 53 is a real time calculation. The alarm 170 may activate when the first impact plane 53 is crossed by the elevator car 23, when the first impact plane 53 is projected to be crossed by the elevator car 23, or when the elevator car 23 is within a certain distance away from the first impact plan 53.

The second trio of transceivers 130*b* are configured to detect a third clearance between the first antenna 120 and the second trio of transceivers 130*b*. A collision risk level is determined in response to the third clearance. The controller 30 may be configured to determine the collision risk level. An alarm 170 may activate when the collision risk level is greater than a selected risk level, which may indicate that a person 200 working on top 23*a* of an elevator car may impact the ceiling 54 of the hoistway 50. The alarm 170 may be audible and/or visual and located in the hoistway 50 and/or worn by the person 200. A second impact plane 55 may be established within the controller 30 to provide added safety margin to the collision protection system 100. The second impact plane 55 may be located at a fourth selected distance D4 away from the second impact wall 54. The second impact plane 55 is a real time calculation in response to the first antenna 120. The alarm 170 may activate when the second impact plane 55 is crossed by the first antenna 120, when the second impact plane 55 is projected to be crossed by the first antenna 120, or when the first antenna 120 is within a certain distance away from the second impact plan 55. In one embodiment, instead of or in addition to the alarm 170, power may be cut to the elevator system 10 or a safety brake 24 may be applied in order to halt movement and reduce the risk of harm to the person 200.

As mentioned above, in another embodiment, there may be multiple first antennas 120 worn by a single person 200. For example, a single person 200 may wear an antenna on their torso, two more on their arms or hands, two more on their legs or feet, and one more on their head. These first antennas 120 may help keep track of the location of the not only person 200 but also all the extremities of the person 200. In an embodiment, the collision protection system 100 may be able to track the location of the extremities of the person 200 relative to moving components of elevator system 10 and then shut down the elevator system 10 and/or activate an alarm 170 if an extremity of the person 200 is too close to a moving component. Moving components of the elevator system 100 may include moving equipment, rotating equipment, and/or pinch points such as, for example the drive unit 20, the machine 22, the brake 24, the pulley system 26, and the counterweight 28.

Figure 3:
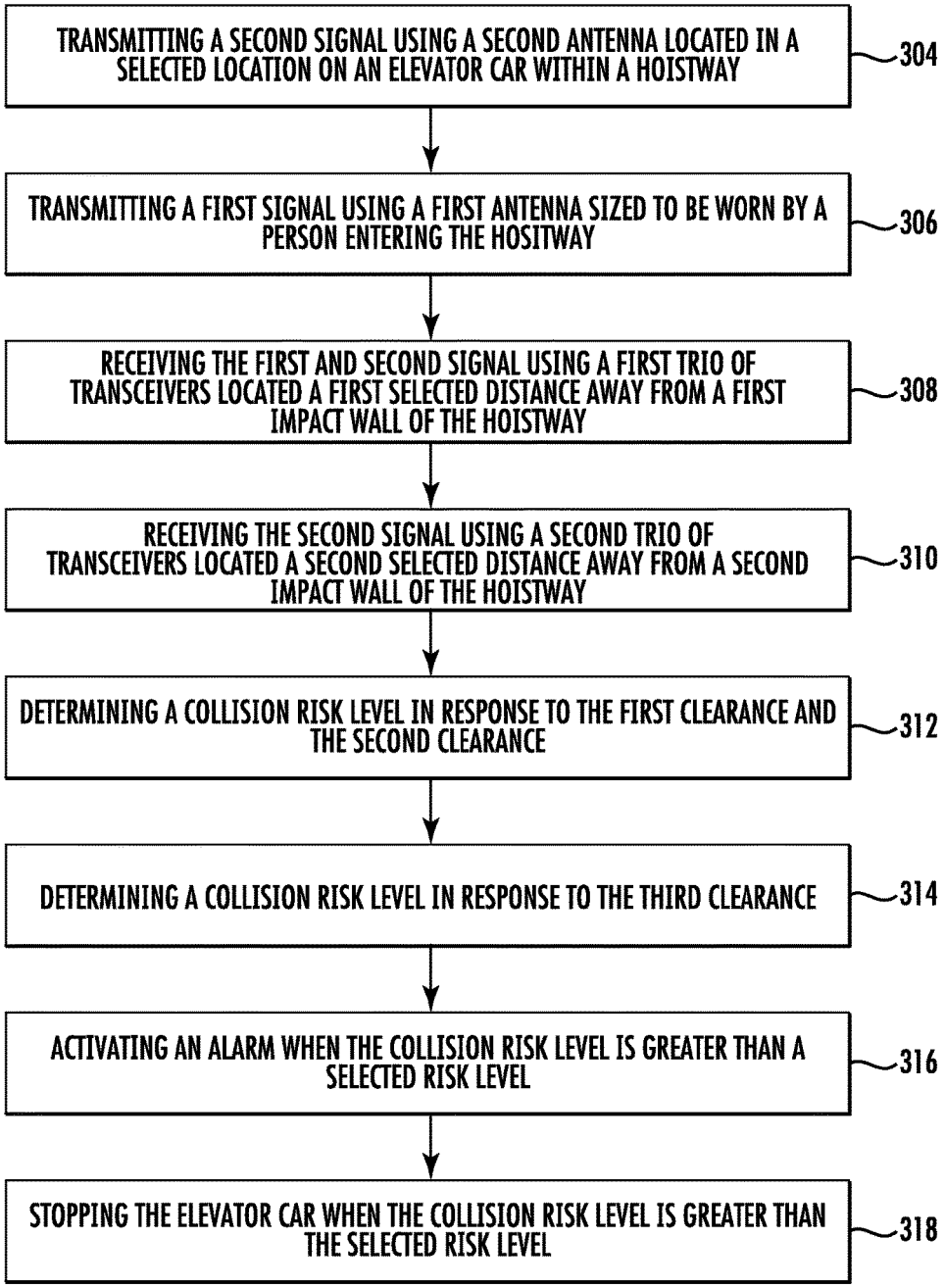
FIG. 3 is a flow chart of a method of preventing a collision within an elevator hoistway, in accordance with an embodiment of the disclosure.

Referring now to FIG. 3, with continued reference to FIGS. 1-2. FIG. 3 shows a flow chart of method 300 of preventing a collision within an elevator hoistway 50, in accordance with an embodiment of the disclosure. At block 304, a second signal is transmitted using a second antenna 110 located in a selected location on an elevator car 23 within a hoistway 50. At block 306, a first signal is transmitted using a first antenna 120 configured to be worn by a person 200 entering the hoistway 50. At block 308, the first and second signal are received using a first trio of transceivers 130*a* located a first selected distance D1 away from a first impact wall 52 of the hoistway 50. As mentioned above, the first trio of transceivers 130*a* are configured to detect a first clearance between the second antenna 110 and the first trio of transceivers 130*a* and a second clearance between the first antenna 120 and the first trio of transceivers 130*a*. At block 310, the first signal is received using a second trio of transceivers 130*b* located a second selected distance D2 away from a second impact wall 54 of the hoistway 50. As mentioned above, the second trio of transceivers 130*b* are configured to detect a third clearance between the first antenna 120 and the second trio of transceivers 130*b*.

At block 312, a collision risk level is determined in response to the first clearance and the second clearance. At block 314, a collision risk level is determined in response to the third clearance. At block 316, the alarm 170 may be activated when the collision risk level is greater than a selected risk level. The collision risk level may be determined by the controller 30. At block 318, the elevator car 23 may be stopped when the collision risk level is greater than the selected risk level. In an example, the brake 24 may be utilized to stop the elevator car 23.

While the above description has described the flow process of FIG. 3 in a particular order, it should be appreciated that unless otherwise specifically required in the attached claims that the ordering of the steps may be varied.

As described above, embodiments can be in the form of processor-implemented processes and devices for practicing those processes, such as processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator car collision protection system comprising:

a first antenna configured to be worn by a person entering a hoistway;

a first trio of transceivers located a first selected distance away from a first impact wall of the hoistway, the first trio of transceivers being configured to detect a first clearance between an elevator car within the hoistway and the first trio of transceivers and a second clearance between the first antenna and the first trio of transceivers; and an alarm configured to activate when a collision risk level exceeds a selected risk level, wherein the collision risk level is determined in response to the first clearance and the second clearance.

2. The elevator collision protection system of claim 1, further comprising:

a second antenna located in a selected location on the elevator car within the hoistway, wherein the first trio of transceivers is configured to detect the first clearance between the elevator car within the hoistway and the first trio of transceivers using the second antenna.

3. The elevator collision protection system of claim 2, further comprising:

a second trio of transceivers located a second selected distance away from a second impact wall of the hoistway, the second trio of transceivers being configured to detect a third clearance between the first antenna and the second trio of transceivers;

wherein the alarm is configured to activate when a collision risk level is greater than a selected risk level, wherein the collision risk level is determined in response to the third clearance.

4. The elevator collision protection system of claim 2, wherein:

the elevator car is stopped when the collision risk level is greater than the selected risk level.

5. The elevator collision protection system of claim 2, wherein:

an ultra-wide band network is created between the second antenna, the first antenna, and the first trio of transceivers.

6. The elevator collision protection system of claim 2, wherein:

the first impact wall is at least one of a bottom floor of the hoistway, a top ceiling of the hoistway, and a side wall of the hoistway.

7. A method of preventing a collision within an elevator hoistway, the method comprising:

transmitting a first signal using a first antenna configured to be worn by a person entering a hoistway;

receiving the first signal using a first trio of transceivers located a first selected distance away from a first impact wall of the hoistway, the first trio of transceivers being configured to detect a first clearance between an elevator car within the hoistway and the first trio of transceivers and a second clearance between the first antenna and the first trio of transceivers;

determining a collision risk level in response to the first clearance and the second clearance; and activating an alarm when the collision risk level exceeds a selected risk level.

8. The method of claim 7, further comprising:

transmitting a second signal using a second antenna located in a selected location on an elevator car within a hoistway; and receiving the second signal using the first trio of transceivers;

wherein the first trio of transceivers is configured to detect the first clearance between the elevator car within the hoistway and the first trio of transceivers using the second antenna.

9. The method of claim 7, further comprising:

receiving the first signal using a second trio of transceivers located a second selected distance away from a second impact wall of the hoistway, the second trio of transceivers being configured to detect a third clearance between the first antenna and the second trio of transceivers;

determining a collision risk level in response to the third clearance; and activating an alarm when the collision risk level exceeds a selected risk level.

10. The method of claim 7, further comprising:

stopping the elevator car when the collision risk level is greater than the selected risk level.

11. The method of claim 7, further comprising:

creating an ultra-wide band network between the second antenna, the first antenna, and the first trio of transceivers.

12. The method of claim 7, wherein:

the first impact wall is at least one of a bottom floor of the hoistway, a top ceiling of the hoistway, and a side wall of the hoistway.

13. A computer program product tangibly embodied on a computer readable medium, the computer program product including instructions that, when executed by a processor, cause the processor to perform operations comprising:

transmitting a first signal using a first antenna configured to be worn by a person entering a hoistway;

receiving the first signal using a first trio of transceivers located a first selected distance away from a first impact wall of the hoistway, the first trio of transceivers being configured to detect a first clearance between an elevator car within the hoistway and the first trio of transceivers and a second clearance between the first antenna and the first trio of transceivers;

determining a collision risk level in response to the first clearance and the second clearance; and activating an alarm when the collision risk level exceeds a selected risk level.

14. The computer program of claim 13, wherein the operations further comprise:

transmitting a second signal using a second antenna located in a selected location on an elevator car within a hoistway; and receiving the second signal using the first trio of transceivers;

wherein the first trio of transceivers is configured to detect the first clearance between the elevator car within the hoistway and the first trio of transceivers using the second antenna.

15. The computer program of claim 14, wherein the operations further comprise:

receiving the first signal using a second trio of transceivers located a second selected distance away from a second impact wall of the hoistway, the second trio of transceivers being configured to detect a third clearance between the second antenna and the second trio of transceivers and a fourth clearance between the first antenna and the second trio of transceivers;

determining a collision risk level in response to the third clearance and the fourth clearance; and activating an alarm when the collision risk level exceeds a selected risk level.

16. The computer program of claim 14, wherein the operations further comprise:

stopping the elevator car when the collision risk level is greater than the selected risk level.

17. The computer program of claim 14, wherein the operations further comprise:

creating an ultra-wide band network between the second antenna, the first antenna, and the first trio of transceivers.

18. The computer program of claim 14, wherein:

the first impact wall is at least one of a bottom floor of the hoistway, a top ceiling of the hoistway, and a side wall of the hoistway.

* * * * *